US006155570A

United States Patent [19]

Allison et al.

[11] Patent Number: 6,155,570

[45] Date of Patent: Dec. 5, 2000

[54] MISSLE DETECTION AND LOCATION

[75] Inventors: Rudolph L. Allison, Rockford; Charles E. Montague, St. Charles, both of Ill.

[73] Assignee: Paramount Technologies, Inc., Rockford, Ill.

[21] Appl. No.: 08/886,096

[22] Filed: Jul. 2, 1997

[51] Int. Cl.[7] ..... F41J 5/04

[52] U.S. Cl. ..... 273/373; 273/374; 273/408; 463/49

[58] Field of Search ..... 273/371, 372, 273/373, 374, 403, 404, 408, 375, 377; 463/49–57

[56] References Cited

U.S. PATENT DOCUMENTS

| | | | |
|---|---|---|---|
| 2,076,357 | 4/1937 | Tempest | 273/371 |
| 3,112,110 | 11/1963 | Schulman . | |
| 4,057,251 | 11/1977 | Jones et al. . | |
| 4,244,583 | 1/1981 | Wood et al. . | |
| 4,678,194 | 7/1987 | Bowyer et al. . | |
| 4,768,789 | 9/1988 | Clark | 273/371 |
| 5,209,491 | 5/1993 | Dodge | 273/371 |
| 5,462,283 | 10/1995 | Allen . | |
| 5,486,007 | 1/1996 | Stewart et al. | 273/374 |
| 5,540,445 | 7/1996 | Lee | 273/371 |
| 5,566,951 | 10/1996 | Dart et al. | 273/385 |
| 5,662,333 | 9/1997 | Allen | 273/371 |
| 5,681,004 | 10/1997 | Houriet, Jr. etal. | 273/371 |
| 5,897,116 | 4/1999 | Yiu | 273/408 |

FOREIGN PATENT DOCUMENTS

| | | |
|---|---|---|
| 0082715 | 6/1983 | European Pat. Off. . |
| 181420A1 | 5/1986 | European Pat. Off. . |
| 737842 A2 | 10/1996 | European Pat. Off. . |
| 88 06 580 U | 12/1988 | Germany . |
| 2030877 | 4/1980 | United Kingdom . |
| 2086243 | 5/1982 | United Kingdom . |
| 2122504 | 1/1984 | United Kingdom . |
| WO 8705688 | 9/1987 | United Kingdom . |
| 2198656 | 6/1988 | United Kingdom . |
| WO9504251 | 2/1995 | WIPO . |
| WO9504912 | 2/1995 | WIPO . |

*Primary Examiner*—Michael O'Neill
*Assistant Examiner*—John M. Hotaling, II
*Attorney, Agent, or Firm*—Cook, Alex, McFarron, Manzo, Cummings & Mehler, Ltd.

[57] ABSTRACT

A system is disclosed for detecting and locating missiles such as darts in a target having a plurality of discrete target areas in which each of the areas has a conductive surface which acts as an electromagnetic signal receiving antenna, and in which a plate is positioned on the back of the target which functions as an electromagnetic signal transmitting antenna. Each of the target areas are monitored for electromagnetic signals and the signals pass through a pin conductor to the monitoring equipment. When a dart is embedded in one of the areas, it also acts as an antenna and, thereby, increases the signal strength of that area to permit detection of the presence and location of the dart. The pin conductors and plate antenna at the back of the dart board substantially improve the discrimination and reliability of the system.

23 Claims, 3 Drawing Sheets

MISSLE DETECTION AND LOCATION

BACKGROUND AND SUMMARY OF INVENTION

The present invention relates to the electronic detection of darts or other missiles which are embedded in discrete scoring segments or areas of a target, such as in a conventional fiber or bristle dart board.

Various approaches have been taken in the past to automatically detect and electrically score games which employ a projectile which is to be propelled toward some form of target having areas denominated in different scores. One example of such game is the game of darts in which a dart is thrown at a dart board having plural segments or areas of differing scores. Depending upon which segment the dart becomes embedded in, the game player is credited with the score for that area.

One prior system in which the location of the dart is automatically detected and electrically scored is shown for example in U.S. Pat. No. 4,057,251 (JONES et al.). In that system the scoring segments are formed by a plurality of movable plates having holes therein. When the tip of a thrown dart enters one of the holes in a plate, the plate is mechanically displaced by the momentum of the dart so as to close and actuate an electrical switch to detect and locate the position of the dart on the dart board. However, these moveable mechanical plate and switch systems have a number of disadvantages including complexity, reliability and longevity.

In another prior system the moveable mechanical plates have been eliminated and the dart board is formed of multiple, sandwiched layers of alternating conductive and insulative materials. When the metal tip of a dart is embedded in a scoring segment or area, it pierces and electrically connects two such conductive layers completing a circuit between them to indicate the location of the dart. Examples of such systems are shown in U.S. Pat. No. 4,244,583 (WOOD et al.) and published UK Patent Application No. 2,030,877. A principal disadvantage of the latter systems is their reduced longevity due to the deterioration of the scoring segments after repeated piercing.

Various systems have also been proposed in which transmitting and receiving antennae are provided for the transmission of electromagnetic signals, and in which one of the antennae is formed by treating or otherwise coating the conventional sisal fibers of a conventional dart board so as to render the fibers electrically conductive to form one of these antennae. In these conductive fiber systems, when a metal tipped dart is embedded in the conductive fibers, the dart itself becomes a part of the antenna in which it is embedded and, thereby, increases the signal strength of either the received or transmitted signal depending upon the function of the conductive material in which the dart is embedded. Examples of these systems are shown in U.S. Pat. Nos. 4,678,198 (BOWYER et al.) and 5,462,283 (ALLEN). Some of the disadvantages of these systems are their low scoring reliability and/or difficulty of placement or overall size of at least one of the antennae.

Still other systems have relied upon the generation of electromagnetic fields utilizing individual coils fixed adjacent the respective scoring areas. When a dart having the ability to affect the electromagnetic activity is embedded in one of the areas, the field generated by the coil is altered and the alteration is detected to indicate the presence and location of the dart. Examples of these systems are described in German Utility Model G 88 06 580.4 and published UK Patent Application No. 2,086,243. One of the disadvantages of these systems is that they are complex and cumbersome due to the need for placement and energization of the numerous and space consuming electromagnetic coils.

More recently a system has also been proposed which like some of the prior systems can utilize a conventional sisal fiber dart board, but which avoids the need to coat or otherwise treat the fibers with an electrically conductive compound, and which relies on a principle of interference with electromagnetic radiation by an embedded dart, rather than the dart acting as part of a transmitting/receiving electromagnetic radiation antenna. An example of such system is shown in published PCT Application No. W095/04251. Although this system enjoys a number of advantages over the prior systems earlier described herein, there is still room for improvement in reliability, simplicity and reduction in manufacturing ease and expense.

A system incorporating the principles of the present invention for automatically detecting and locating a missile embedded in a target, such as a dart in a dart board, enjoys one or more advantages over the aforementioned systems of the prior art. One such advantage is that the system of the present invention is simple, and is easier and less expensive to construct and assemble than many of the systems of the prior art. In the system of the present invention, an antenna is positioned on the back of the target so that it can be essentially equidistant to all of the scoring segments on the front of the target. This results in substantially improved reliability and simplicity, eliminates the need for an antenna external to the dart board, and in the case of the prior systems which required the spacing of an antenna peripherally of the dart board scoring area, reduces the size of the overall game assembly. Positioning of the antenna at the back of the dart board also substantially reduces the power needed from the signal generator. In addition, the system of the present invention enjoys an order of magnitude of improvement in reliability which will insure that even where darts are embedded in a scoring segment closely adjacent the next scoring segment, the location of the dart in the proper and correct segment will be easily discriminated and accurately read virtually all of the time.

In one principal aspect of the present invention, a system is provided for detecting and locating a missile embedded in a target having a front face with a plurality of target areas formed of a first material into which first material one or more of the missiles may be selectively embedded from the front face of the target. A first electrically conductive area is located in the target areas and adjacent the front face, and a back is provided on the target opposite the front face. A second electrically conductive area is positioned adjacent the back, and the second electrically conductive area is spaced and electrically separated from the first electrically conductive area. A signal generator imparts a signal to one of the aforementioned conductive areas whereby that one of the conductive areas defines a transmitting antenna for an electromagnetic signal corresponding to the signal imparted to the one conductive area. The other of the conductive areas defines a receiving antenna for the electromagnetic signal which is transmitted from the transmitting antenna. A processor is electrically connected to the other of the conductive areas and distinguishes between a first electromagnetic signal which is received and sensed by the other of the conductive areas in the absence of a missile in a given target area, and a second electromagnetic signal which is an alteration of the first electromagnetic signal by the presence of a missile in the given target area to permit the detection of the presence and location of the missile.

In another principal aspect of the present invention, the first material comprises dart board bristles and the first electrically conductive area comprises a conductive coating on the bristles.

In still another principal aspect of the present invention, the aforementioned bristles have a given depth, and the first electrically conductive area is located within that bristle depth adjacent to the front face of the target and extends for a depth into the bristles which is less than the given depth.

In still another principal aspect of the present invention, the system includes an electrically insulative barrier extending into the first material for a depth greater than the depth of the first electrically conductive area, and the insulative barrier defines the plurality of target areas and electrically divides and separates the first electrically conductive areas of adjacent target areas from each other.

In still another principal aspect of the present invention, the second electrically conductive area adjacent the back of the target is an electrically conductive plate and, more preferably, one which is painted onto the target back.

In still another principal aspect of the present invention, the system includes still another electrically conductive plate in addition to the last mentioned plate adjacent to the back, and an insulative material electrically separates the two conductive plates.

In still another principal aspect of the present invention, an electrically conductive pin is coupled to the first conductive area so as to substantially increase the electromagnetic signal in the first conductive area.

In still another principal aspect of the present invention, the first electrically conductive area is the receiving antenna and the second electrically conductive area is the transmitting antenna which transmits the electromagnetic signal from the back of the target to the receiving antenna at the front face of the target and to a missile when the missile is embedded in the first material.

In still another principal aspect of the present invention, the missile is a dart and the target is a dart board.

These and other objects, features and advantages of the present invention will be more clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENT

Figure 1:
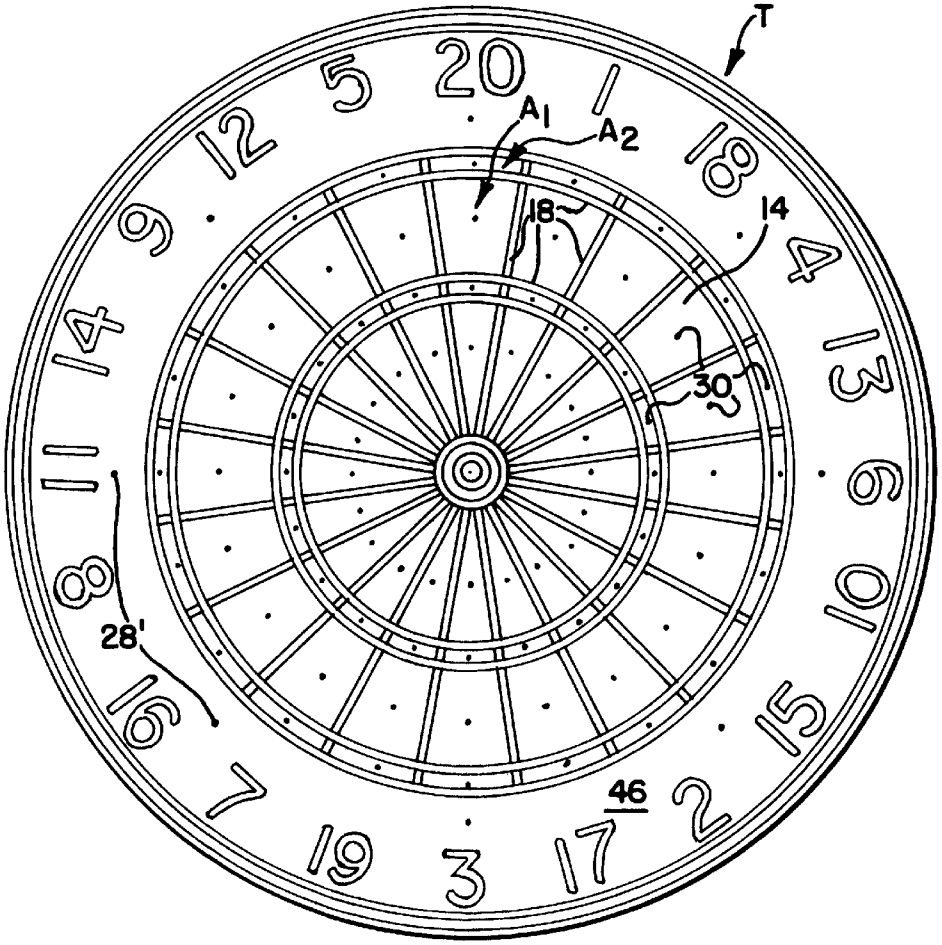
FIG. 1 is an overall frontal plan view of a dart board incorporating a preferred embodiment of system of the present invention.

As previously mentioned, the present invention relates to the automatic detection and location of a missile or projectile relative to a target, and the electrical scoring thereof. As shown in FIG. 1, the target may be a dart board T which has a plurality of discrete target scoring segments or areas $A_1$, $A_2$, etc., and which scoring areas have preselected but differing score values. Although a dart board T is described as an example of a target in which the missile detection and location of the present invention may be utilized, it will be appreciated that the invention may be employed in other uses and games which also employ some form of target and missile, such as archery.

Figure 2:
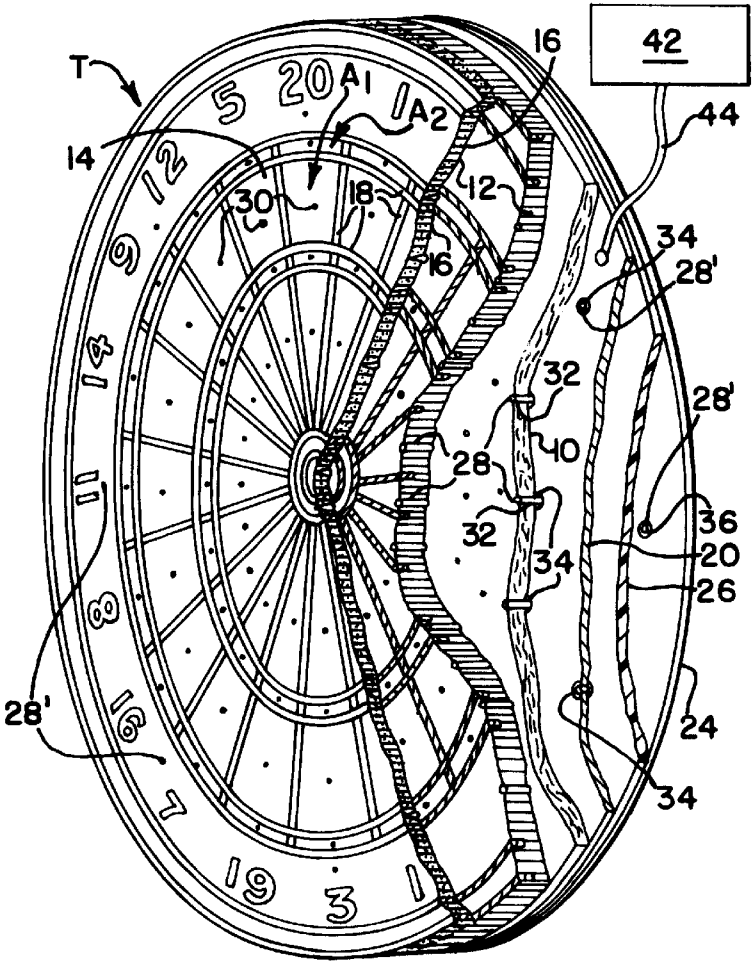
FIG. 2 is an isometric view of the dart board as substantially shown in FIG. 1, but which has been partially broken away to show the several structural layers of the dart board and the construction of the system of the present invention.
Figure 3:
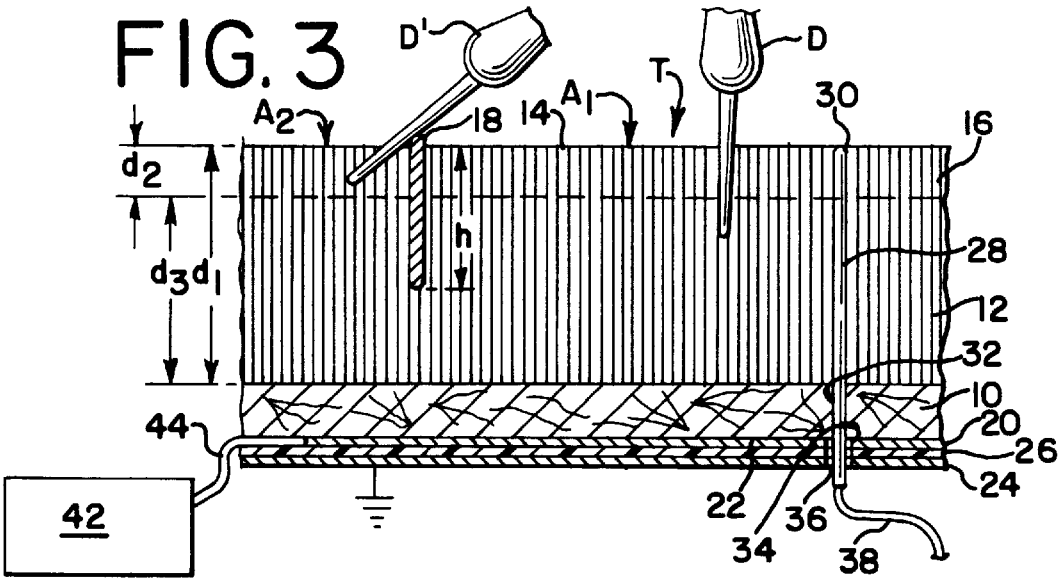
FIG. 3 is a broken, cross-sectioned, enlarged side elevation view of the dart board substantially as shown in FIG. 2 and which shows several darts embedded in the dart board and greater detail of the layers and construction of the dart board.

Referring more particularly to FIGS. 2 and 3, the dart board T is preferably of a relatively conventional construction, i.e. of a wood or chip board base 10 which is electrically insulative in nature, and having a plurality of organic sisal fibers 12 adhesively fixed to the front face of the base 10. The sisal fibers 12 extend frontally and outwardly from the base 10 and they are typically sheared to present a flat target front face 14 for receipt of darts D and D' which are to be embedded therein during game play, as seen in FIG. 3.

In the system of the present invention the outer tips of the fibers 12 adjacent the face 14 are processed or treated preferably by dipping or painting with an electrically conductive material, such as graphite or the like. This conductive material may be applied by coating it onto the exposed front face of the bristles or fibers after the fibers have been assembled and adhered to the base 10. In the alternative, individual bundles of the fibers or bristles may be dipped to a preselected depth of liquid coating material, dried, and then the other uncoated ends of the fibers are adhered to the front face of the base 10. In either event the fibers 12 are not coated to their full depth $d_1$, but instead are only coated to a superficial depth $d_2$, as shown in FIG. 3. The remainder of the depth $d_3$ of the fibers which is not coated will be essentially non-electrically conductive in view of the typical organic nature of the fibers. The coated fiber tips thereby define a conductive area 16 covering the target front face 14. This conductive area 16 will define an antenna for an electromagnetic signal as will be described below.

After the fibers 12 have been assembled and fixed to the base 10, have been coated to form the conductive area 16, and have been sheared as necessary to form the flat target front face 14, the several scoring areas $A_1$, $A_2$, etc. are formed by isolating and electrically separating the conductive area 16 into pieces and for each scoring area. This is preferably accomplished by pressing a preformed, preferably molded plastic electrically insulative spider 18 into the fibers from the target front face 14. This dart board spider 18 has a height h, as best seen in FIG. 3, which is sufficiently greater than the depth $d_2$ of the conductive area 16 to insure that the conductive areas 16 of each of the respective scoring areas $A_1$, $A_2$, etc. are isolated and separated electrically from each other. By way of example, the total depth $d_1$ of the fibers or bristles 12 may be approximately ⅞ inch, the depth $d_2$ of the conductive area 16 may be approximately ¼ inch, and the height h of the spider 18 may be approximately ⅝ inch. However, it will be appreciated that these heights and depths may vary somewhat without departing from the principles of the invention.

One important feature of the present invention is the positioning of another conductive area or layer 20 on the back 22 of the base 10 as shown in FIGS. 2 and 3. This conductive area or layer 20 may be a conductive metal plate or foil adhered or otherwise attached to the back face 22 of the base 10. However, the conductive area 20 is preferably applied to the back face 22 by painting or coating it on using for example a nickel based paint. As will be described below, this conductive area 20 will also function as an antenna for electromagnetic signals. It will be appreciated upon considering the construction and application of this conductive area 20, that the assembly of the system will be simplified, and that the antennae provided by the conductive areas 16 and 20 respectively will be substantially equidistant from each other which will greatly improve the reliability of the system.

A second electrically conductive plate 24 or the like is also preferably provided at the back of the target T as shown in FIGS. 2 and 3. This plate 24 is electrically separated from the conductive area or layer 20, again as best seen in FIGS. 2 and 3, by an insulative plate 26 which may be formed of any suitable insulative material, such as a phenolic polymer. As shown in FIG. 3, the conductive plate 24 is grounded to minimize undesirable electrical interference and improve reliability.

Another important feature of the present invention is the provision of a conductive nail or pin 28 which extends between the conductive area 16 in each of the target scoring areas $A_1$, $A_2$ etc. rearwardly through the back of the dart board. The pins 28 may be installed rearwardly through the fibers 12 from the target face 14. However, the pins 28 are preferably installed in the other direction, i.e. by being driven from the back 22 of the target T through the base 10, forwardly through the nonconductive depth $d_3$ of the fibers 12 and into the depth $d_2$ of the conductive area 16 of the fibers 12 as shown in FIG. 3. The tips 30 of the pins 28 are preferably pointed to facilitate such placement and installation, and to minimize the possibility of undesirable dart tip deflection when a dart tip strikes the dart board. The pin tips 30 are also preferably slightly beneath the target face 14, as viewed in FIG. 3, so that they are not actually visible at the target face 14. The pin tips 30 have only been shown in FIGS. 1 and 2 on the target face 14 for the purpose of a full understanding of their placement relative to the scoring areas $A_1$, $A_2$, etc. However, it will be appreciated that in reality these tips 30 preferably would not be visible on the target face 14.

As shown in FIG. 3, the pins 28 are preferably inserted through openings 32 in the base 10 which are slightly smaller in diameter than the diameter of the pins to ensure a firm press fit when the pins 28 are driven through the openings 32. On the other hand, the openings 34 and 36 through the conductive plates 20 and 24, respectively, are larger than the diameter of the pins 28 to ensure that the pins 28 are electrically separated and isolated from the plates 20 and 24. The end of each of the pins 28 at the rear of the target is connected by a suitable conductor 38, as seen in FIGS. 3 and 4, to a processor and score display 40 for receiving the signals present in the conductive area 16 of the respective scoring areas $A_1$, $A_2$ etc., and processing them to display a score as shown in FIG. 4.

Figure 4:
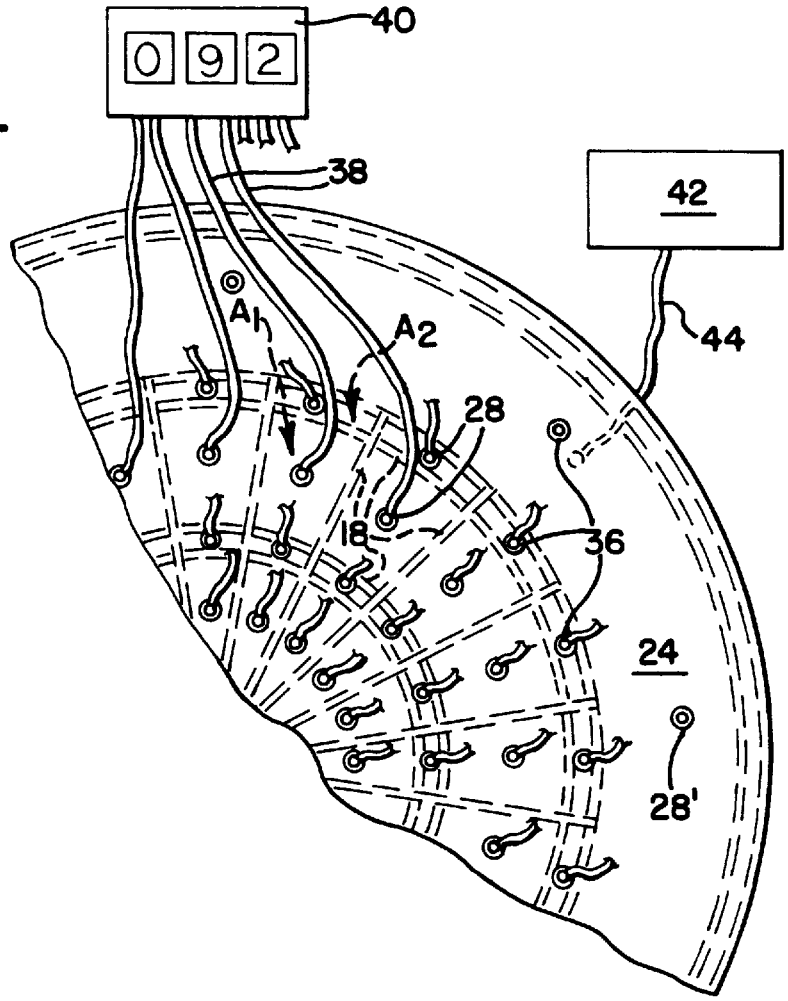
FIG. 4 is a partially broken, rear plan view of the dart board incorporating the system of the present invention.

A signal generator 42, as shown in FIGS. 2–4, is also provided for the transmission of a suitable signal, for example of 125 khz, through a conductor 44 to the conductor plate 20.

As shown in FIGS. 1 and 2, a non-scoring shoulder ring 46 typically encircles and surrounds the scoring region in a conventional dart board. Such ring provides an area to display the scoring indicia and the like and provides an adjacent area to catch darts which may just miss the scoring region. Although darts embedded in this ring 46 are not entitled to a score, it is preferable to be able to detect their presence and score them as a zero because each player only gets three darts in the usual scoring round. Thus, if the presence of darts embedded in this ring can be detected, the system will be more easily able to automatically determine when a player has completed his round. Accordingly, the construction of the board in the shoulder ring 46 area is preferably similar to the remainder of the scoring region and its target areas A, $A_2$, etc. For this purpose, a plurality of pins 28', for example eight in number, are preferably located in spaced relation from each other about the board and in the non-scoring shoulder ring 46, as seen in FIGS. 1 and 2.

To use the system of the invention as described above, it is first electrically energized. When energized, a signal will be imparted to the electrically conductive area 20 at the back 22 of the target T and its base 10 by the signal generator 42 and conductor 44 as seen in FIGS. 2–4. Because the conductive area 20 at the back of the target T forms an antenna, the signal which is imparted to it will be transmitted from the antenna area 20 as a discrete electromagnetic signal, and this transmitted signal will be picked up and received by the conductive area 16 on the front face 14 of the target T which acts as a receiving antenna. The signals received in the area 16 in each of the respective target scoring areas $A_1$, $A_2$, etc. will be relatively constant and uniform in the absence of any embedded darts due to the uniform and fixed distance between the conductive areas 16 and 20 because of the positioning of the latter on the front and back of the target, respectively.

The signals received at the conductive areas 16 in each of scoring areas $A_1$, $A_2$, etc. will be communicated by the respective conductor pins 28 through the back of the target and via the respective conductors 38 to the processor 40. In the absence of any embedded darts, these signals will remain constant and no score will be registered on the display part of the precessor 40. However, when the metal tip of a dart D becomes embedded for example in scoring area $A_1$, as shown in FIG. 3, the dart D will add to the antenna effect of the conductive area 16 in area $A_1$ and, thereby, will alter the signal which is received in area $A_1$ to increase its voltage. Accordingly, this increased intensity voltage signal will be detected by the processor 40 which will determine that it came from scoring area $A_1$ and the processor will process and display the score for that scoring area. Subsequently thrown darts will likewise be processed and their scores added to the scores of the earlier thrown darts.

As previously mentioned, an important feature of the invention is the provision of pins 28 as conductors coupling the conductive area 16 of the respective scoring areas $A_1$, $A_2$, etc. to the back 22 of the target T. These pins 28 are selected to be of a suitable mass and the like so as to approximately simulate a dart D embedded in each of the scoring areas $A_1$, $A_2$ etc. In this manner the pins 28 will substantially improve the reliability and accuracy of the system by substantially increasing the level of discrimination between a dart D which embeds in the scoring area to be read, e.g. area $A_1$ as shown in FIG. 3, and a dart D' which embeds in a next adjacent scoring area $A_2$ but is quite close to and/or overlies the scoring area $A_1$ being read, also as shown in FIG. 3.

Figure 5:
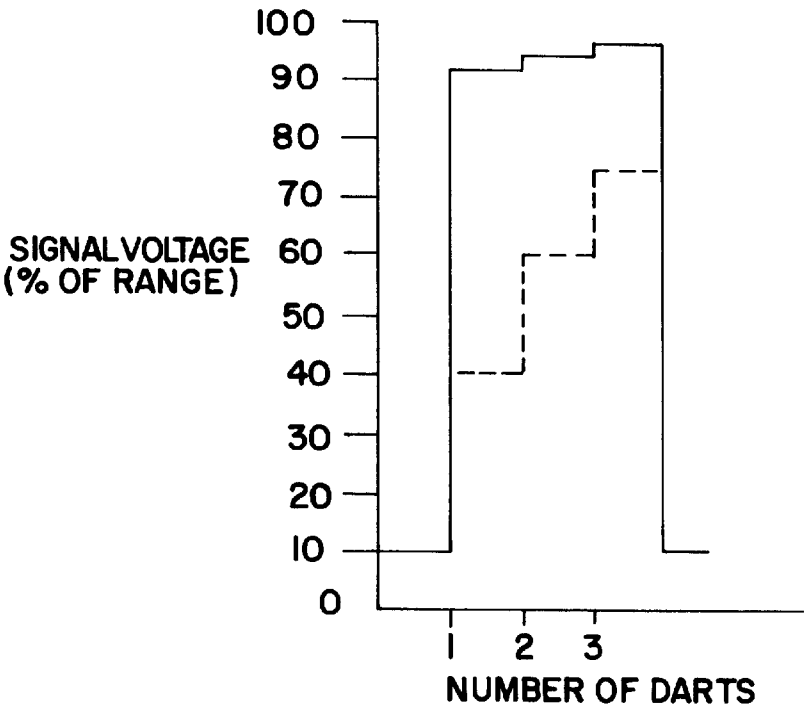
FIGS. 5 and 6 are rough graphical depictions of the signal profiles and strengths produced by the system of the present invention and, respectively, without and with the conductor pins which are a feature of the present invention.
Figure 6:
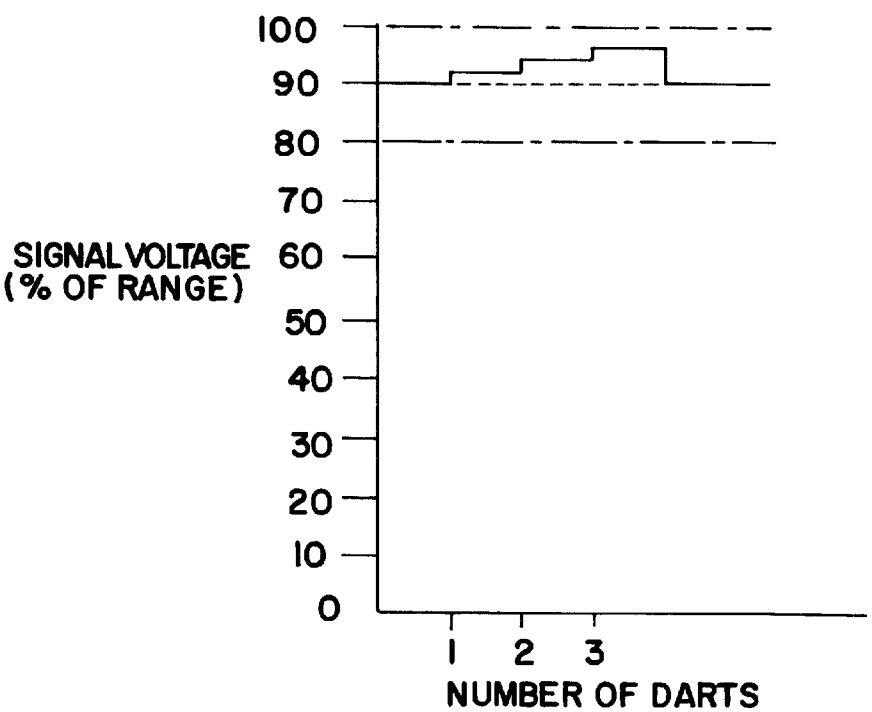

In this regard reference is made to FIGS. 5 and 6 which show exemplary graphical depictions of representative signal voltages in percentage of voltage range plotted against number of darts embedded. FIG. 5 shows the signal voltages without a conductor pin 28 and having just a simple light weight conductor from the conductive area 16. FIG. 6 depicts the signal voltages with the conductor pins 28 of the invention.

If a dart D', as shown in FIG. 3, becomes embedded in scoring area $A_2$ which is next to and closely adjacent the scoring area $A_1$ which is being read, and the dart D' assumes for example the position as shown in which it overlies the area $A_1$, the dart D' will not only act to substantially raise the signal voltage as it should in the scoring area $A_2$ in which it is embedded, but it will also tend to have some measurable effect on the signal voltage level in area $A_1$ in which it is not embedded. This latter effect on the adjacent area Al is schematically shown in FIG. 5 by the dotted line. As shown in FIG. 5, the dart D' which has embedded in area $A_2$ which is closely adjacent to area $A_1$ may increase the ambient signal voltage from the approximately 10 percent level as shown with no darts in the target, to the approximately the 40 percent voltage level in the area $A_l$—the area adjacent the area $A_2$ in which the dart D' is actually embedded. The voltage level in the area $A_2$ in which the dart D' is actually embedded also will rise as it should to a substantially higher level of approximately 92 percent of the voltage of range, also as shown in FIG. 5.

If a second dart is also embedded in area $A_2$ and closely adjacent to the area $A_1$ as was the first dart D', there may be a still further increase in the signal voltage in area $A_1$ of up to for example 60 percent as shown by the dotted line in FIG. 5. As desired, there also will be a further slight increase in the signal voltage in area $A_2$ in which the dart is actually embedded up to for example 94 percent from the 92 percent voltage level, as shown in FIG. 5. If still a third dart is embedded in the same manner as the first two darts in area $A_2$, the signal voltage in area $A_1$ will further increase to for example 75 percent, while the signal voltage in area $A_2$ will also increase from 94 as it should to approximately 96 percent as shown in FIG. 5.

From this it will be seen that although a substantial difference exists between the signal voltage levels in the respective scoring areas $A_1$ and $A_2$ in a no-pin system, and which substantial difference should permit relatively reliable discrimination between the two adjacent areas, the increases in voltage levels in the area $A_1$ in which the dart is not embedded are more than simply nominal and may be sufficient to result in occasional false readings and a reduction in reliability.

Referring now to FIG. 6 which depicts the signal voltage levels in the invention which includes the conductor pins 28, it will be seen that the pins 28 establish an increased ambient signal level condition with no darts which is greater than the levels which are produced in area $A_1$ in FIG. 3 by the dart D' which is embedded in the adjacent area $A_2$. This increased ambient signal level is preferably similar but a bit less than starting a game with a dart embedded in each of the scoring areas $A_1$, $A_2$ etc. on the dart board T. In this condition, the ambient signal voltage at the beginning of a game with no darts embedded in the board will already present signal voltage levels which may be approximately 90 percent of the overall voltage level range as shown in FIG. 6, rather than the low ambient voltage levels of about 10 percent as shown in FIG. 5. Now when one or more darts do become embedded in a scoring area, for example when dart D' embeds in area $A_2$ as shown in FIG. 3, the signal voltage in area $A_2$ will only increase in small increments of about 2 percent for each dart as depicted in FIG. 6. However, due to the higher ambient signal voltage level already present in each of the areas $A_1$, $A_2$ etc. due to the pins 28, any undesirable effect on signal voltage in closely adjacent scoring areas, such as in area $A_1$ as seen in FIG. 3, will be obscured by the already relatively large ambient signal voltage level in area $A_1$, and will have little if any effect as will be seen by the dotted line in FIG. 6. Moreover, the signal voltage window which is actually scanned may be substantially electronically narrowed to for example between 80 and 100 percent, as depicted by the dot and dash lines in FIG. 6, because all of the activity of any significance to be monitored, including the ambient no dart condition, is in that range. Thus, any dart-in-adjacent-area effect may be filtered out and the scale in the 80–100 percent range may be expanded to detect smaller variations in signal voltage as the result of sequential embedding of darts.

Also and as previously discussed, a substantial increase in reliability is possible in the system of the present invention due to the placement of the conductive area 20 at the back of the dart board T. Such placement insures the substantial uniformity of electromagnetic signal at all of the target areas $A_1$, $A_2$, etc. and the conductive area 16 at the front face 14 of the target T.

It will also be appreciated from the foregoing description of the preferred embodiment of the system of the invention, that the system is capable of rapid, accurate and inexpensive assembly, and a conventional readily available dart board may be easily and quickly adapted to the system of the invention with a minimum of modifications. Moreover, the spider 18 which separates the target areas $A_1$, $A_2$, etc. may be manufactured by simple injection molding techniques from any one of a number of readily available suitable polymers, and the spider may be simply, easily and accurately installed in and held into the target face 14 by pressing the spider into the bristles or fibers 12. Furthermore, the system of the invention is quite compact and does not require the provision of antennae and the like which are located outside of the confines of the perimeter of the dart board itself.

It also will be appreciated that although in the foregoing description of the operation of the system of the invention the conductive area 20 has been described as a transmitting antenna and the conductive area 16 as a receiving antenna, these roles may be reversed. If reversed and a signal is imparted to the conductive area 16, the signal to each of the target areas $A_1$, $A_2$ etc. will likely be sequentially applied to each of the respective target areas and/or each signal will be unique in some characteristic to its particular area, such as frequency. This would permit recognition and identification of each of the respective target areas and the ability to distinguish them from each other.

It also will be understood that the preferred embodiment of the present invention which has been described is merely illustrative of the principles of the invention. Numerous modifications may be made by those skilled in the art without departing from the true spirit and scope of the invention.

We claim:

1. A system for detecting and locating a missile embedded in a target, comprising:

a target having a front face, said front face having a plurality of target areas formed of a first material into which first material one or more of the missiles may be selectively embedded from the front face of the target;

a first electrically conductive area in each of the target areas and adjacent said front face;

a back on said target opposite said front face;

a second electrically conductive area adjacent said back, said second electrically conductive area being spaced substantially equidistantly, from said first electrically conductive area in substantially each of said target areas, and electrically separated from said first electrically conductive area;

signal generating means for imparting a signal to one of said conductive areas whereby said one of said conductive areas defines a transmitting antenna for an electromagnetic signal corresponding to the signal imparted to said one of said conductive areas, and the other of said conductive areas defines a receiving antenna for the electromagnetic signal which is transmitted from the transmitting antenna; and processing means electrically connected to the other of said conductive areas, said processing means distinguishing between a first of said electromagnetic signals which is received and sensed by the other of said conductive areas in the absence of a missile in a given target area, and a second electromagnetic signal which second signal is an alteration of said first electromagnetic signal by the presence of a missile in said given target area to permit the detection of the presence and location of the missile.

2. The system of claim 1, wherein said first material comprises dart board bristles, and said first electrically conductive area comprises a conductive coating on said bristles.

3. The system of claim 2, wherein said bristles have a given depth, and said first electrically conductive area is located within said bristle depth adjacent to said front face and extends for a depth into said bristles which is less than said given depth.

4. The system of claim 3, including an electrically insulative barrier extending into said first material for a depth greater than the depth of said first electrically conductive area, said insulative barrier defining said plurality of target areas and electrically dividing and separating the first electrically conductive areas of adjacent target areas from each other.

5. The system of claim 1, wherein said first material has a given depth, and said first electrically conductive area is located within said first material adjacent said target face and extends for a depth into said first material which is less than said given depth.

6. The system of claim 5, including an electrically insulative barrier extending into said first material for a depth greater than the depth of said first electrically conductive area, said insulative barrier defining said plurality of target areas and electrically dividing and separating the first electrically conductive areas of adjacent target areas from each other.

7. The system of claim 1, wherein said second electrically conductive area adjacent said back is an electrically conductive plate.

8. The system of claim 7, wherein said plate is painted onto the target back.

9. The system of claim 7, including another electrically conductive plate adjacent said back, and insulative material electrically separating said conductive plates.

10. The system of claim 1, including an electrically conductive pin which is electrically coupled to said first electrically conductive area and which substantially increases the electromagnetic signal in said first electrically conductive area.

11. The system of claim 5, including an electrically conductive pin which is electrically coupled to said first electrically conductive area and which substantially increases the electromagnetic signal in said first electrically conductive area.

12. The system of claim 1, wherein said first electrically conductive area is said receiving antenna and said second electrically conductive area is said transmitting antenna which transmits said electromagnetic signal from said back of the target to the receiving antenna at the front face of the target and to a missile when the missile is embedded in said first material.

13. The system of claim 4, wherein said first electrically conductive area is said receiving antenna and said second electrically conductive area is said transmitting antenna which transmits said electromagnetic signal from said back of the target to the receiving antenna at the front face of the target and to a missile when the missile is embedded in said first material.

14. The system of claim 10, wherein said first electrically conductive area is said receiving antenna and said second electrically conductive area is said transmitting antenna which transmits said electromagnetic signal from said back of the target to the receiving antenna at the front face of the target and to a missile when the missile is embedded in said first material.

15. The system of claim 11, wherein said first electrically conductive area is said receiving antenna and said second electrically conductive area is said transmitting antenna which transmits said electromagnetic signal from said back of the target to the receiving antenna at the front face of the target and to a missle when the missile is embedded in said first material.

16. The system of claim 1, wherein the missile is a dart and the target is a dart board.

17. The system of claim 4, wherein the missile is a dart and the target is a dart board.

18. The system of claim 5, wherein the missile is a dart and the target is a dart board.

19. The system of claim 7, wherein the missile is a dart and the target is a dart board.

20. The system of claim 10, wherein the missile is a dart and the target is a dart board.

21. The system of claim 12, wherein the missile is a dart and the target is a dart board.

22. The system of claim 1, wherein said second electrically conductive area is on said back.

23. The system of claim 1, wherein said target has a perimeter, and wherein said second eclectically conductive area is within said perimeter.

* * * * *

UNITED STATES PATENT AND TRADEMARK OFFICE

CERTIFICATE OF CORRECTION

PATENT NO. : 6,155,570 
DATED : December 5, 2000
INVENTOR(S) : Rudolph L. Allison and Charles E. Montague It is certified that error appears in the above-identified patent and that said Letters Patent is hereby corrected as shown below:

Column 7,
Line 7, delete "A1" and insert -- $A_1$ --.
Line 13, delete "$A_I$—" and insert -- $A_1$ --.

Signed and Sealed this

Fourteenth Day of January, 2003

JAMES E. ROGAN
*Director of the United States Patent and Trademark Office*